US010009984B2

(12) United States Patent
Creemers et al.

(10) Patent No.: US 10,009,984 B2
(45) Date of Patent: Jun. 26, 2018

(54) LIGHTING DEVICE WITH FIRST AND SECOND COUPLED AND INTER-MOVABLE ANTENNAS

(71) Applicant: PHILIPS LIGHTING HOLDING B.V., Eindhoven (NL)

(72) Inventors: Henricus Mathijs Maria Creemers, Eindhoven (NL); Marijn Geels, Eindhoven (NL); Dirk Jan Van Kaathoven, Eindhoven (NL); Rober Henri Denker, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days. days.

(21) Appl. No.: 15/557,867

(22) PCT Filed: Feb. 19, 2016

(86) PCT No.: PCT/EP2016/053554

§ 371 (c)(1),
(2) Date: Sep. 13, 2017

(87) PCT Pub. No.: WO2016/146339

PCT Pub. Date: Sep. 22, 2016

(65) Prior Publication Data

US 2018/0054877 A1 Feb. 22, 2018

(30) Foreign Application Priority Data

Mar. 17, 2015 (EP) ..... 15159422

(51) Int. Cl.
*H05B 37/02* (2006.01)
*H01Q 1/22* (2006.01)
(Continued)

(52) U.S. Cl.
CPC ..... *H05B 37/0272* (2013.01); *F21K 9/238* (2016.08); *F21V 23/0435* (2013.01);
(Continued)

(58) Field of Classification Search
CPC ... H05B 37/02; H05B 37/0272; F21V 23/005; F21V 23/0435; F21K 9/238; H01Q 1/22; H01Q 1/44
See application file for complete search history.

(56) References Cited

U.S. PATENT DOCUMENTS

2011/0006898 A1* 1/2011 Kruest ..... H01Q 1/2208 340/568.1
2012/0274208 A1* 11/2012 Chen ..... H01Q 1/38 315/34
(Continued)

FOREIGN PATENT DOCUMENTS

CN 102798018 A 11/2012
EP 2808596 A1 12/2014
(Continued)

*Primary Examiner* — Thai Pham

(57) ABSTRACT

Presented is a lighting device (100) with a light source and a heat dissipating element, comprising: an RF communication circuit (102); a first antenna (105) electrically connected to the RF communication circuit and supported by a first portion (115) of lighting device; and a second antenna (125) adapted to communicate with external devices and electromagnetically coupled with the first antenna so that the second antenna is adapted to be excited by and to excite the first antenna, the second antenna is adapted to communicate with external devices and being supported by a second portion of the lighting device, wherein the second portion of the lighting device is movable with respect to the first portion of the lighting device.

15 Claims, 10 Drawing Sheets

(51) Int. Cl.

| | |
|---|---|
| ***H01Q 1/44*** | (2006.01) |
| ***F21V 29/70*** | (2015.01) |
| ***F21V 23/04*** | (2006.01) |
| ***F21K 9/238*** | (2016.01) |
| *F21Y 115/15* | (2016.01) |

(52) U.S. Cl.
CPC ..... *F21V 29/70* (2015.01); *H01Q 1/22* (2013.01); *H01Q 1/44* (2013.01); *F21Y 2115/15* (2016.08)

(56) References Cited

U.S. PATENT DOCUMENTS

| | | | | |
|---|---|---|---|---|
| 2013/0136454 | A1* | 5/2013 | Yu | H05B 33/0803 398/106 |
| 2013/0155664 | A1* | 6/2013 | Kim | F21L 4/02 362/184 |
| 2015/0109781 | A1* | 4/2015 | Van Der Merwe | F21V 23/0435 362/249.01 |

FOREIGN PATENT DOCUMENTS

| | | | |
|---|---|---|---|
| JP | 2010157453 | A | 7/2010 |
| WO | WO2010140136 | A1 | 12/2010 |
| WO | WO2013031043 | A1 | 3/2013 |
| WO | WO2013153522 | A1 | 10/2013 |
| WO | WO2014173852 | A1 | 10/2014 |
| WO | WO2015014564 | A1 | 2/2015 |

* cited by examiner

LIGHTING DEVICE WITH FIRST AND SECOND COUPLED AND INTER-MOVABLE ANTENNAS

CROSS-REFERENCE TO PRIOR APPLICATIONS

This application is the U.S. National Phase application under 35 U.S.C. § 371 of International Application No. PCT/EP2016/053554, filed on Feb. 19, 2016, which claims the benefit of European Patent Application No. 15159422.3, filed on Mar. 17, 2015. These applications are hereby incorporated by reference herein.

FIELD OF THE INVENTION

This present invention relates to the field of lighting devices, and more particularly to a lighting device with a first and second antennas suitable for communication of RF signals.

BACKGROUND OF THE INVENTION

Intelligent lighting has become widespread, and RF communication is a technology widely used for remote management of lighting devices. Instead of controlling the power (e.g. 230V supply) to the lighting device, the recent trend has moved towards directly controlling the light source or lighting device (i.e. the exchangeable lighting element lighting device) by sending an RF control signal to the lighting device.

It is preferable that the performance of an RF antenna in such a lighting device is not disturbed by other lamp components made from electrically conductive materials (or non-conductive materials that may lower the Q factor or resonance frequency) which, for example, could shield the RF signal in certain directions or change the resonant frequency of the RF antenna, and thus significantly influence the RF communication with remote controls or other lighting devices. Thus, it is preferred that the RF antenna radiates with significant directive gain in a large solid angle.

WO2013153522 describes a lighting device with a first antenna arrangement and a second antenna arrangement. Wherein a heat sink and a lamp foot form the second antenna arrangement, and the second antenna arrangement communicate with a remote control. The first antenna arrangement connects to a control unit in the lamp and is arranged in close vicinity of the second antenna arrangement for allowing near-field coupling of a radio frequency signal provided by the second antenna to control the at least one light source.

SUMMARY OF THE INVENTION

It would also be advantageous that the antenna performance can be flexibly adjusted to reach optimization.

According to an aspect of the invention, there is provided a lighting device comprising: an RF communication circuit; a first antenna electrically connected to the RF communication circuit and supported by a first portion of lighting device; and a second antenna electromagnetically coupled with the first antenna so that the second antenna is adapted to be excited by and to excite the first antenna, the second antenna being supported by a second portion of the lighting device, wherein the second portion of the lighting device is movable with respect to the first portion of the lighting device.

The moving of the second portion with respect to the first portion may be used for improving the antenna performance in various ways.

First, it may be used for altering the electromagnetic coupling between the first and second antennas.

Proposed is a concept for a lighting device with an antenna arrangement suitable for reliable communication of RF signals in a wide directivity pattern. By employing first and second antennas, a first antenna can be designed with compact dimensions (so as to fit within predetermined housing dimensions, for example) and used to excite a second antenna which can be larger (so as to provide increased antenna efficiency and bandwidth) and/or positioned to provide an improved omnidirectional radiation pattern. Embodiments may therefore provide for improved compatibility and/or improved spatial communication range. Also, the first and second antennas being electromagnetically coupled may provide antenna diversity.

A lighting device according to an embodiment may therefore be designed with compact dimensions. As a result, embodiments may be suited for low energy replacement lamps which can be directly remote controlled, e.g. with respect to such as on/off, intensity, color, beam width, and light orientation.

Further proposed is a concept for altering the electromagnetic coupling between the first and second antennas by supporting the first and second antennas on respective portions of the lighting device which are movable with respect to each other. By adapting the second antenna to be movable with respect to the first antenna, the electromagnetic coupling between the first and second antennas can be modified/altered and tuned to an optimal value for example. In other words, the coupling between the first and second antennas can be changed by moving a second portion of the lighting device (upon which the second antenna is provided) relative to a first portion of the lighting device (upon which the first antenna is provided).

In an embodiment, the first portion of the lighting device may comprise a body part situated in a housing of the lighting device, and the second portion of the lighting device may comprise a cap part mounted on the housing of the lighting device. By way of example, the cap part may be rotatably mounted on the housing such that it can be rotatable moved with respect to the housing. Such rotation of the cap part, upon which the second antenna is supported, may thus result in movement of the second antenna with respect to the first antenna, thereby altering the electromagnetic coupling between the first and second antennas. Embodiments may therefore enable simple, quick and/or easy modification (e.g. tuning) of the coupling between the first and second antennas by rotating the cap relative to the housing. Such rotation of the cap may be achieved manually or by an electromechanically arrangement (which can be controlled according to predetermined requirements for example).

The cap part may comprise an optically transmissive part through which light from a light source can pass. In other words, the cap part may comprise a transparent or translucent part arranged to permit the passage of light from the light source therethrough. Also, the second antenna may be at or near the peripheral edge of the optically transmissive part. In this manner, the second antenna would not block the optically transmissive part thus would not influence the light emitting. Further, the peripheral edge may be opaque so as to hide the second antenna.

In an embodiment, the body part may comprise: a cup side wall comprising heat sink material, wherein a top opening of the cup is for engaging the cap part; a support plate placed at the middle of the cup for supporting said light source, and comprising heat spreader material thermally coupled to said light source and said cup side wall; and a PCB above said support plate, comprising a trace printed thereon as said first antenna. This embodiment provides a more detailed structure for the lamp.

In an embodiment, the lighting device may comprise a light source that is oriented facing the cap part and adapted to generate light along an optical axis, and the second antenna may be supported by the cap part so as to be positioned above a virtual plane drawn orthogonal to the optical axis and through the first antenna. In this way, the second antenna may be positioned so as to be suitable for reliable communication of RF signals in a wide directivity pattern. Such positioning may also enable the second antenna to be realized with larger dimensions than the first antenna, for example due to size constraints placed on an antenna situated within a housing of the lighting device. Also, arrangement of the second antenna above the first antenna may enable the second antenna to be positioned such that it is less obstructed or shielded by, for example, components and/or a housing of the lighting device. In this way, the second antenna may provide for an in improved or optimized omnidirectional radiation pattern.

The second portion may be rotatable with respect to said first portion so as to adjust the angle between said second antenna and said first antenna. In this way, the angle, and thus the coupling, between the first and second antennas may be adjustable.

The second portion of the lighting device may be displaceable upward and downward with respect to said first portion of the lighting device so as to adjust the vertical distance between said second antenna and said first antenna. In this way, the vertical distance, and thus the coupling, between the first and second antennas may be adjustable.

The second portion of the lighting device may comprise recesses placed at different radial locations for receiving said second antenna such that the radial distance between the second antenna and the first antenna is adjustable. In this way, the coupling between the first and second antennas may be adjustable.

Hence, embodiments may provide a lighting device, such as a miniature replacement lamp, which still allows a wide spatial range of wireless RF communication with the lighting device in spite of a small overall size.

The first antenna may be one of: an IFA antenna; a PIFA antenna; a Yagi antenna; and a loop antenna. In the latter case, a balun circuit may not be needed, since only a balanced output may be required.

The second antenna may comprise a metallic component having an extension no larger than ½ of a wavelength of RF control signals communicated by the first antenna. Embodiments may make use of an RF-signal at the frequency of 2.4 GHz so that, in free air, the total wavelength of such a signal is 12.5 cm. Through a using of a proper type antenna, such as a dipole antenna, the length of the second antenna may be shortened in length to ½ wavelength (6.25 cm) or ¼ wavelength (3.13 cm), assuming free air with no disturbance. However, the second antenna may be enclosed by the second portion that may be made of plastic, for example, which may influence its characteristics such that some adjustments (or 'antenna matching' features) are needed. For example, the physical length of the second antenna may be made slightly shorter than 6.25 cm or 3.13 cm. Accordingly, it will be understood that the adjusted length of the second antenna may depend of the type and amount of material surrounding it. By arranging the second antenna in this way, increased antenna efficiency and bandwidth may be obtained when compared to the first antenna. Embodiments may therefore enable RF communication and thus RF control of a lighting device over a wide range of angles.

Alternatively, moving of the second portion with respect to the first portion may be used for altering the radiation pattern of the second antenna with respect to the first portion. For example, if the second antenna is a directional antenna, such moving would change the direction of the main radiation of the second antenna with respect to the first portion. In real cases, after the lighting device has been installed, the first portion such as the main lamp body is fixed, and the operator can move, such as rotate the second portion to tune the direction of the second antenna to better communicate with the external wireless transceiver.

Embodiments may further comprise a control circuit arranged to control a function of the lighting device in accordance with data received in an RF signal received via the first and second antennas and the RF communication circuit. For example, the function may be one or more of: on/off, intensity, color, beam width, and light orientation.

Embodiments may provide a lighting device having a standard shaped power socket for receiving electric power to power the light source, such as a power socket being one of: E27, E14, E40, B22, GU-10, GZ10, G4, GY6.35, G8.5, BA15d, B15, G53, and GU5.3. Thus, there may be provided a lighting device which can be a low energy replacement lamp for replacement of halogen spots or incandescent lamps.

The light source may comprise at least one of: a CF (compact fluorescent) light source, a Luminescent Foil light source, and a Light Emitting Diode (LED), such as an OLED or a PolyLED or a set of LEDs of different colors. The LED(s) may be any type of LED, such as a Flip Chip type (Thin Film Flip Chip), Patterned Sapphire Substrate, top connected/top emission, top-bottom connected.

A light output section (or light emission area) of a light source refers to an area towards or through which light from the light source is output (or emitted). Accordingly the light output direction may be generalised to be in a vertical direction (e.g. upwardly in the Figures) along which light is output from the light output section of the light source. However, it will be understood that not all light output from a light output section may be output exactly vertically. Thus, the light output direction (or optical axis) should be understood to refer to the general upwardly extending direction that light may be output from a light source, extending away from the surface of the light output section of a light source for example.

Embodiments may be employed in conjunction with new or existing lamps. For example, an embodiment may be retro-fitted to a conventional lamp, whereas another embodiment may be integrated into a new lamp at time of manufacture. Accordingly, an aspect of the invention may provide lamp comprising a lighting device according to an embodiment.

Embodiments may be employed in the field of automotive lighting, stadium lighting, home/residential lighting, temporary lighting, and other fields/applications where remotely controllable lighting is desirable.

Embodiments may be employed in conjunction with a remote control unit for wireless RF control of a lighting device. Accordingly, as aspect of the invention may provide a lighting system comprising a lighting device according to an embodiment and a remote control unit adapted to communicate an RF signal for controlling of at least one parameter of the lighting device.

These and other aspects of the invention will be apparent from and elucidated with reference to the embodiment(s) described hereinafter.

BRIEF DESCRIPTION OF THE DRAWINGS

Examples in accordance with aspects of the invention will now be described in detail with reference to the accompanying drawings, in which.

DETAILED DESCRIPTION OF THE EMBODIMENTS

Figure 1:
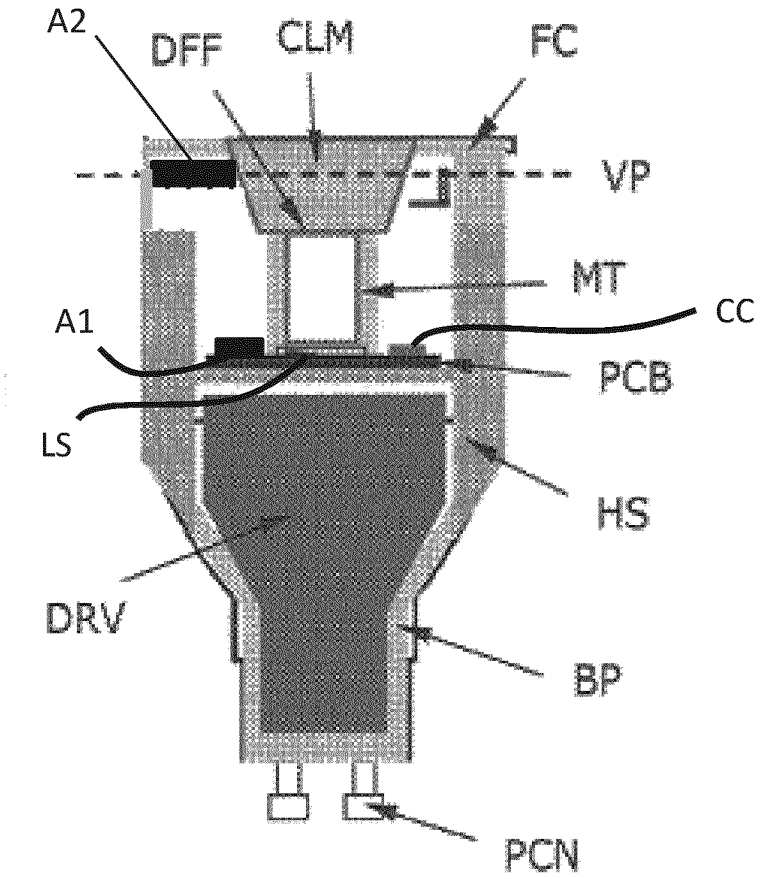
FIG. 1 illustrates a sketch of a section through retrofit spot lamp according to an embodiment.

In a first aspect of the invention it proposes a specific structure of the first antenna and second antenna in lamp wherein the second antenna that communicates with external devices is displaced far from the heat element. More specifically it provides a lighting device with a light source and a heat dissipating element, comprising: an RF communication circuit; a first antenna electrically connected to the RF communication circuit and supported by a first portion of lighting device; and a second antenna adapted to communicate with external devices and electromagnetically coupled with the first antenna so that the second antenna is adapted to be excited by and to excite the first antenna, the second antenna being supported by a second portion of the lighting device, wherein said second portion is displaced from said heat dissipating element. More specifically, the heat dissipating element comprises the heat spreader 115 and the heat sink wall 120, as will be discussed below.

In a second aspect of the invention it provides a light device comprising two antennas that are movable with respect to each other. One purpose is to alter the electromagnetic coupling between the antennas. Embodiments may be of particular relevance to applications that require RF control of a lighting device over a wide range of angles.

In the following description elucidation, the first aspect and the second aspect are elucidated together and it should be understood that the first and second aspects can also be independent innovations.

Embodiments employ the concept of providing for a lighting device with an antenna arrangement suitable for reliable communication of RF signals in a wide directivity pattern. By employing first and second antennas, the first antenna can be made to be compact so as to fit within predetermined housing dimensions, for example. This first antenna can be arranged excite (or be excited by) a second antenna which can be made to be larger so as to provide increased antenna efficiency and bandwidth and/or positioned to provide an improved omnidirectional radiation pattern.

Embodiments also employ the concept of supporting the first and second antennas on respective portions of the lighting device which are movable with respect to each other. By adapting the second antenna to be movable with respect to the first antenna, the electromagnetic coupling between the first and second antennas can be modified/altered and tuned to an optimal value for example. In other words, the coupling between the first and second antennas can be changed by moving a second portion of the lighting device (upon which the second antenna is provided) relative to a first portion of the lighting device (upon which the first antenna is provided).

The term vertical, as used herein, means substantially orthogonal to the surface of a substrate. The terms lateral or horizontal, as used herein, means substantially parallel to the surface of a substrate. Also, terms describing positioning or locations (such as above, below, top, bottom, etc.) are to be construed in conjunction with the orientation of the structures illustrated in the diagrams.

The diagrams are purely schematic and it should therefore be understood that the dimensions of features are not drawn to scale. Accordingly, the illustrated thickness and/or separation of any of the layers should not be taken as limiting. For example, a first layer drawn as being thicker than a second layer may, in practice, be thinner than the second layer.

FIG. 1 illustrates a sketch of a section through retrofit spot lamp according to an embodiment, wherein the retrofit spot lamp has a GU 10 standard power connector PCN. The spot lamp comprises a light source LS including a set of LEDs, e.g. Red, Green, Blue, colored LEDs. The outer enclosure of the lamp comprises first and second portions.

The first portion (of the outer enclosure) comprises a back part BP formed from a plastic material and a middle part in the form of a metal housing HS with a rib outer structure and connected to a heat sink so as to effectively transport heat from the light source LS. Here, the metal housing HS is formed by aluminium. A power connector PCN penetrates the first portion.

The second portion (of the outer enclosure) is in the form of a plastic front cap FC and is movably mounted to the first portion of the outer enclosure. In this way, the plastic front cap FC can be moved (e.g. rotated or push in/pull out) with respect to the first portion of the outer enclosure.

Inside the outer enclosure, there is provided a driver circuit DRV. The driver circuit includes a mains voltage power converter, a driver for the light source LS and an additional supply for the control chip. The light source LS is positioned on a Printed Circuit Board PCB which also holds control circuit CC components. The printed circuit board PCB is mounted to the metal housing HS of the first portion of the outer enclosure. The PCB may be supported by a metal heat spreader, as shown by the horizontal bar below the PCB and above the drive board DRV. The metal heat spreader thermally coupled to the heat sink HS. This help to transport heat from away from the light source LS to the heat sink.

A hollow hexagonal mixing tube MT with a reflective and electrically conductive material at its inner surface serves to guide light from the light source LS to a plastic collimator CLM. A diffuser DFF is positioned inbetween the collimator and the mixing tube for additional colour mixing.

A first RF antenna A1 is mounted on the printed circuit board PCB. The PCB is ring-shaped which allows the collimator CLM and thus light from the light source LS to pass through the opening inside the ring-shaped PCB. In one version, the first antenna A1 is in the form of an IFA antenna, and an RF transceiver chip, a microprocessor, and a matching circuit serving to match for minimal noise figure and maximum power transfer (e.g. 50Ω matching), are mounted on the same PCB. The close proximity of antenna A1 to the metal heat spreader and heat sink causes the antenna A1 to have a low impedance and low radiation level.

A second RF antenna A2 is mounted on the underside of the plastic front cap FC so that it is adapted to be excited by and to excite the first antenna A1.

By employing first A1 and second A2 antennas, the first antenna A1 is designed with compact dimensions so as to fit within the metal housing HS of the first portion of the outer enclosure. The first antenna A1 is used to excite (and by excited by) the second antenna A2 which is larger since it is not restricted to being fitted within the metal housing HS. In this way, the increased antenna efficiency and bandwidth can be provided. Also, the second antenna A2 is positioned to provide an improved omnidirectional radiation pattern (because, for example, the second antenna A2 is not shielded by the metal housing HS).

The dashed line VP indicates a virtual plane through the second RF antenna A2. As will be seen from the illustration of FIG. 1, major metal objects which are typically disturbing to wireless RF signals reaching or leaving the second RF antenna A2, such as the metal housing HS, are located below the virtual plane VP through the second RF antenna A2. Even small metal objects, e.g. solder material etc. in relation to the circuits mounted on the PCB, are placed below the virtual plane VP through the second RF antenna A2, since preferably such circuits are mounted on the lower side of the PCB, while the first antenna A1 elements are disposed on an upper side of the PCB.

A benefit of this construction is that the power electronics part DRV is shielded from the RF part by metal in between. If there is a coupling, the packet error rate will increase due to modulation of the power supply switching frequency on the transceiver circuit.

Because the front cap FC is movably mounted to the first portion of the outer enclosure, and the second RF antenna A2 is mounted on the front cap FC, the second RF antenna A2 can be moved (e.g. rotated) with respect to the first portion of the outer enclosure. Moving the second antenna A2 with respect to the first antenna A1 modifies/alters the electromagnetic coupling between the first A1 and second A2 antennas. In other words, the coupling between the first A1 and second A2 antennas can be changed by moving (e.g. rotating) the front cap FC (on which the second antenna A2 is mounted) relative to the metal housing HS and the PCB (by which the first antenna A1 is supported).

The spot lamp of FIG. 1 therefore enables simple, quick and easy modification (e.g. tuning) of the coupling between the first A1 and second A2 antennas by rotation of the front cap FC relative to the PCB. Such rotation of the cap can be achieved manually or by an electromechanically arrangement (controlled according to predetermined requirements, for example).

It will be understood that various modifications and/or alternative components may be employed in alternative embodiments. For example, the first antenna may be one of: an IFA antenna; a PIFA antenna; a Yagi antenna; and a loop antenna. In the latter case, a balun circuit may not be needed, since only a balanced output may be required.

The light source may comprise at least one of: a CF (compact fluorescent) light source, a Luminescent Foil light source, and a Light Emitting Diode (LED), such as an OLED or a PolyLED or a set of LEDs of different colors. The LED(s) may be any type of LED, such as a Flip Chip type (Thin Film Flip Chip), Patterned Sapphire Substrate, top connected/top emission, top-bottom connected.

Figure 2:
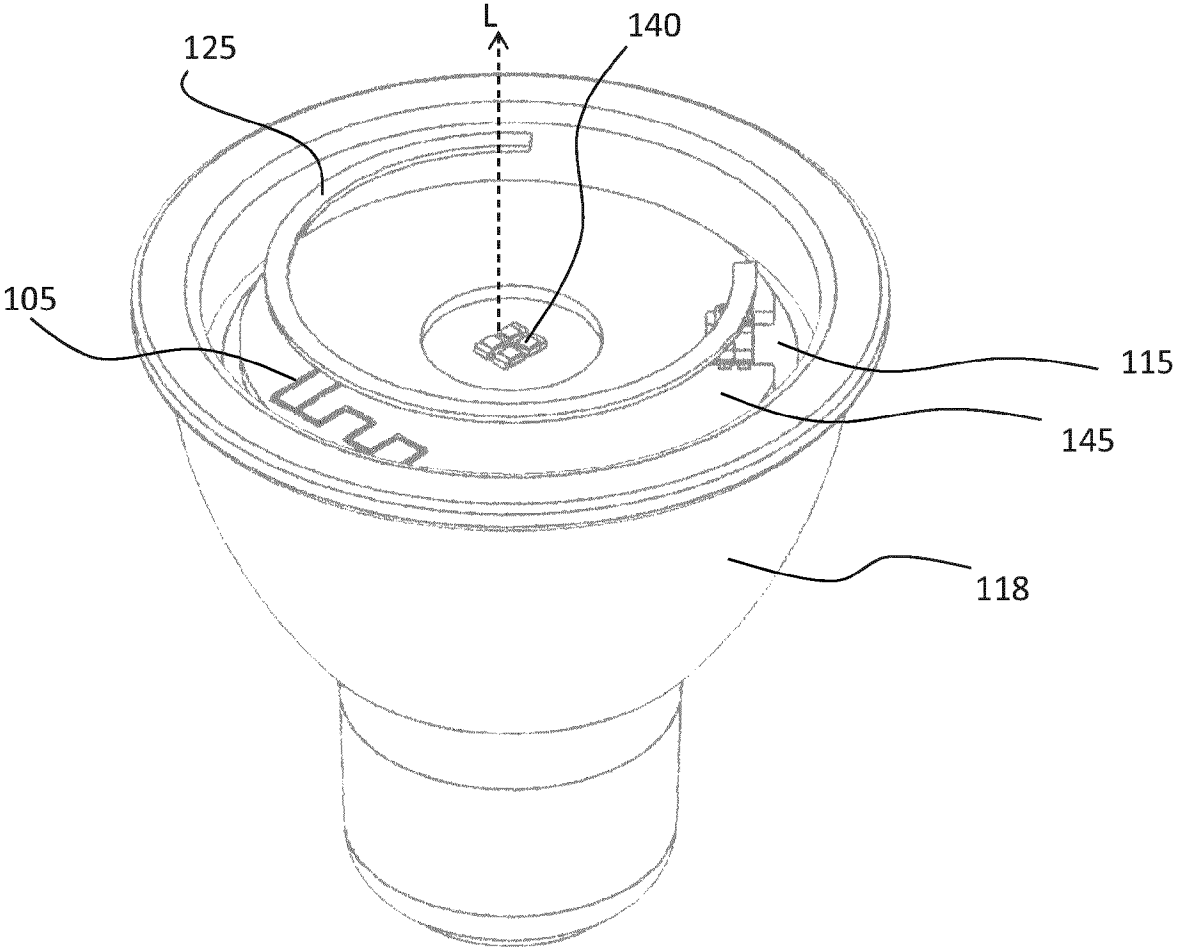
FIG. 2 is an isometric view of a lighting device according to an alternative embodiment, wherein the front cap part has been made transparent so that an arc-shaped antenna mounted thereon is visible (along with components situated inside the housing of the lighting device)
Figure 3:
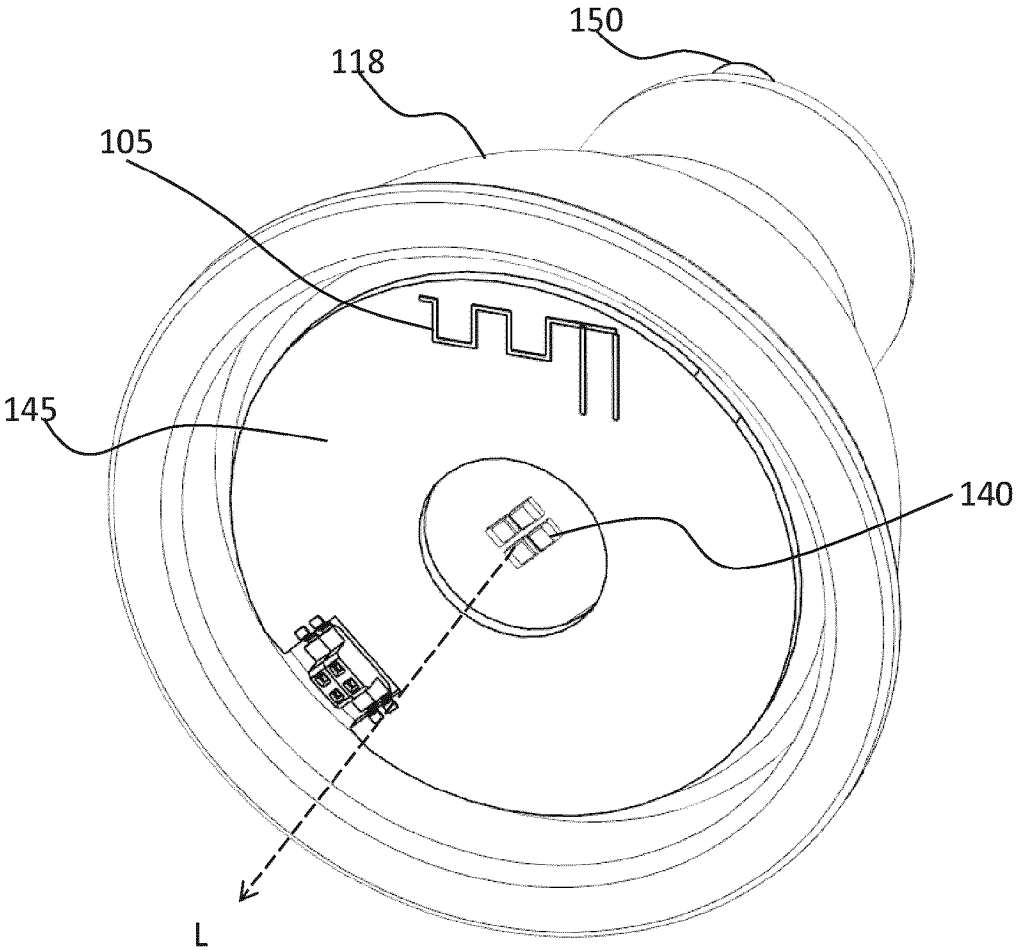
FIG. 3 is an isometric view of the lighting device of FIG. 2 with its front cap part removed.
Figure 4:
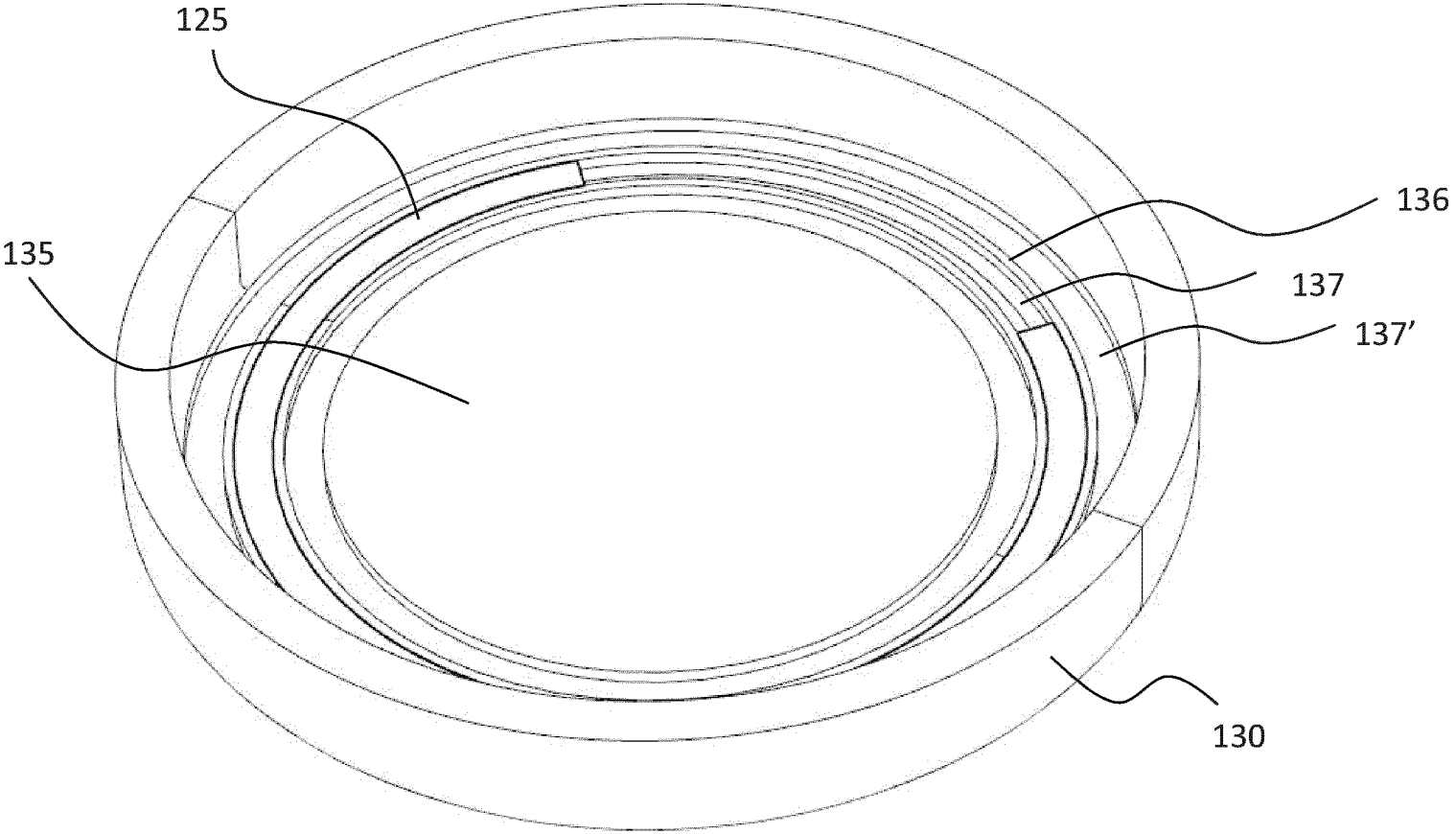
FIG. 4 is an isometric view of the front cap part of the lighting device of FIG. 2.
Figure 5:
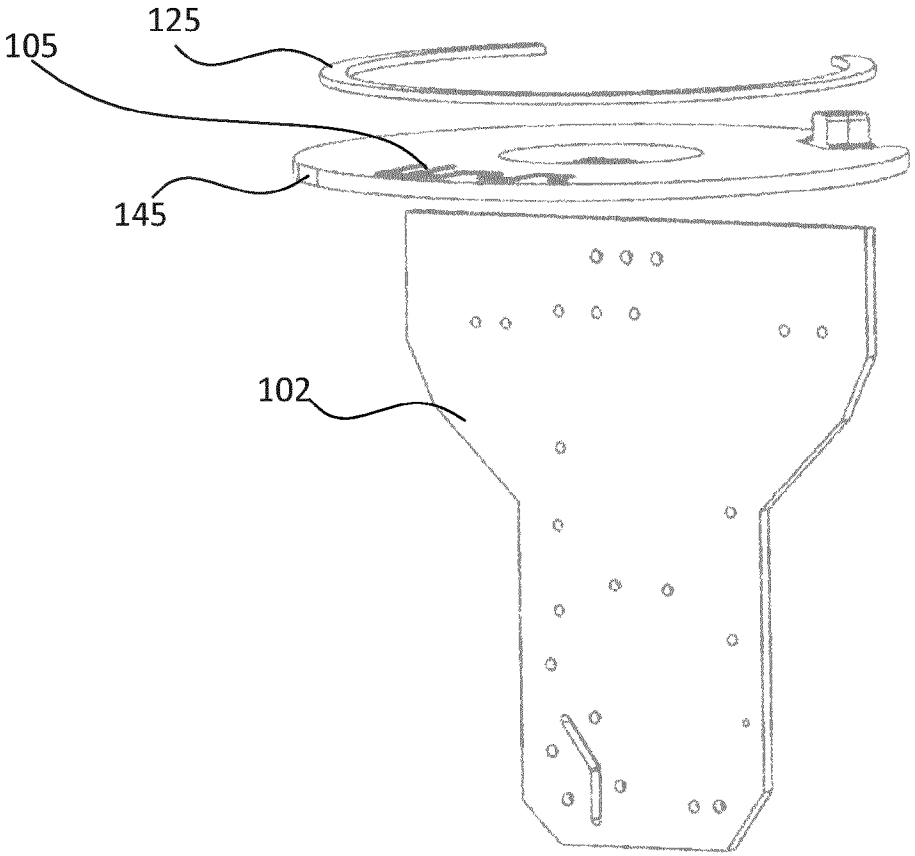
FIG. 5 depicts a relative arrangement of components which are internal to the lighting device of FIG. 2.
Figure 6:
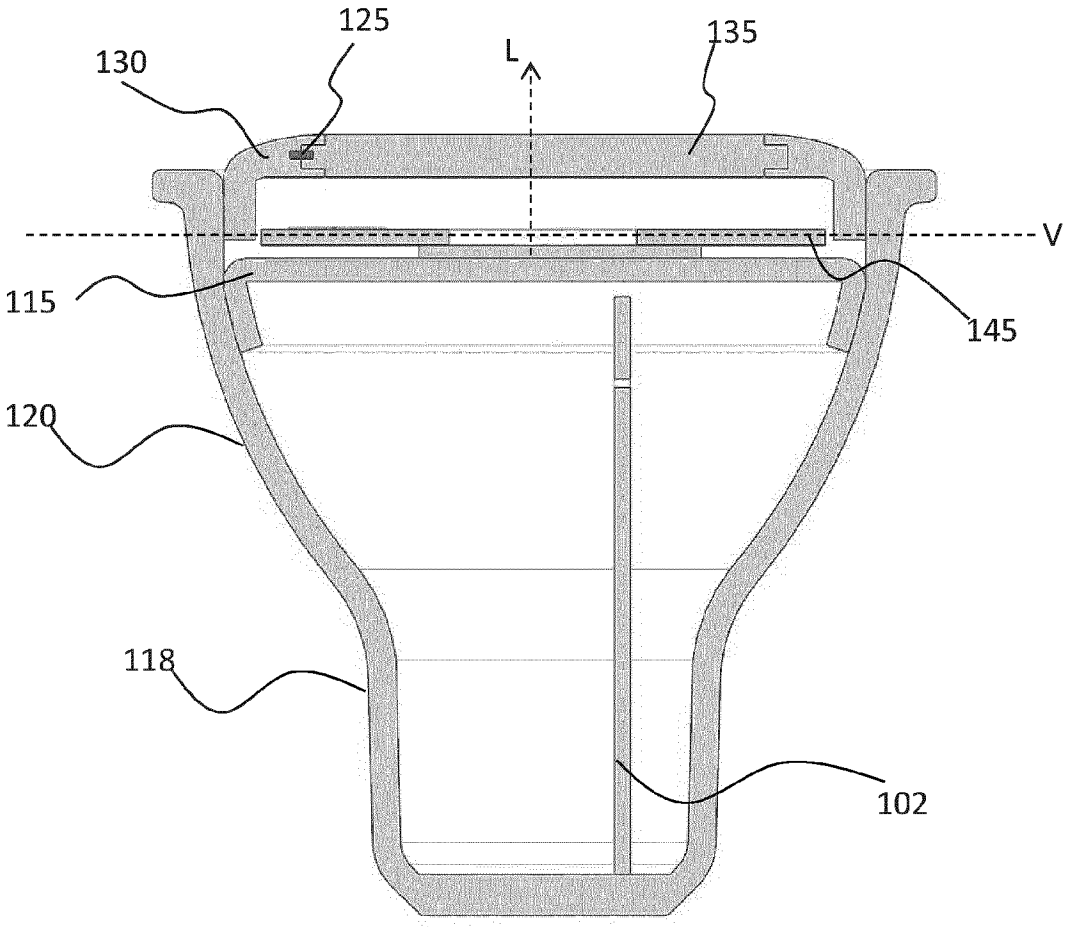
FIG. 6 is a cross-sectional view of the lighting device of FIG. 2.
Figure 7:
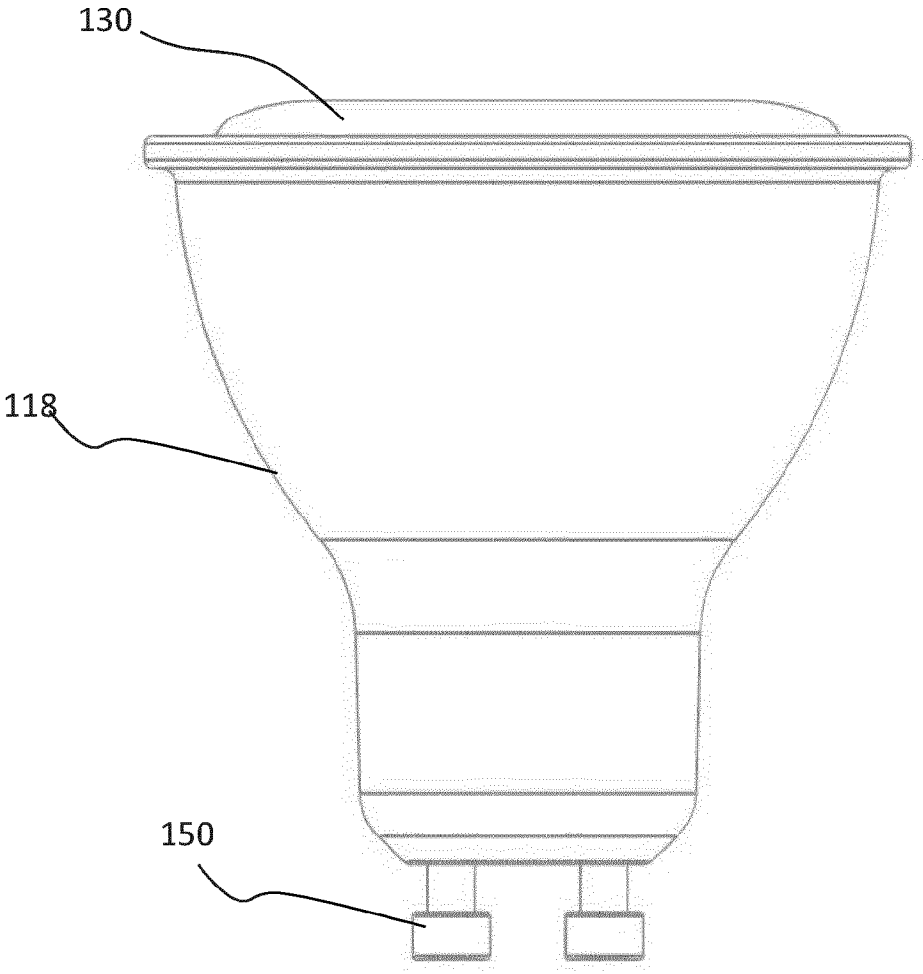
FIG. 7 is a side view of the lighting device of FIG. 2, wherein the lighting device is fitted with a GU 10 standard power connector.

FIGS. 2-8 illustrate a lighting device according to another embodiment. More particularly: FIG. 2 is an isometric view of the lighting device, wherein the front cap part has been depicted as transparent so that an arc-shaped antenna mounted thereon is visible (along with components situated inside the housing of the lighting device), however in real case the cap part above the second antenna may be opaque to hide the second antenna as will be discussed later; FIG. 3 is an isometric view of the lighting device with its front cap part removed; FIG. 4 is an isometric view of the front cap part of the lighting device; FIG. 5 depicts a relative arrangement of components which are internal to the lighting device; FIG. 6 is a cross-sectional view of the lighting device; and FIG. 7 is a side view of the lighting device, wherein the lighting device is fitted with a GU 10 standard power connector.

The lighting device 100 comprises an RF communication circuit 102 in the form of a PCB. A first antenna 105 is electrically connected to the RF communication circuit 102 and supported by a first portion of the lighting device. Here, the first portion comprises a flat support surface 115 which is fixedly mounted to the inner surface of an outer housing 118 of the lighting device 100. This support surface 115 may be a heat spreader.

The lighting device 100 further comprises a second antenna 125 electromagnetically coupled with the first antenna 105 so that the second antenna is adapted to be excited by and to excite the first antenna 105. The second antenna 125 is supported by the underside of a front cap part 130 of the lighting device 100 such that the second antenna 125 is positioned vertically above and spaced apart from the first antenna 105.

The front cap part 130 is rotatably mounted on the outer housing 118 such that it is movable (e.g. rotatable) with respect to the outer housing 118 (and the support surface 115 which supports the first antenna 105). It will therefore be understood that movement of the front cap part 130 with respect to the outer housing 102 results in movement of the second antenna 125 relative to the first antenna 105 thereby alter the electromagnetic coupling between the first 105 and second 125 antennas. Specifically, the rotation of the front cap part 130 with respect to the outer housing 102 results in radial offset of the second antenna 125 from the first antenna 105.

The lighting device 100 therefore employs a concept which enables the electromagnetic coupling between the first 105 and second 125 antennas to be altered. By supporting the first 105 and second 125 antennas on respective portions of the lighting device 100 which are movable with respect to each other, the second 125 antenna is adapted to be movable with respect to the first antenna 105. By moving a second portion of the lighting device (upon which the second antenna 125 is provided) relative to a first portion 110 of the lighting device (upon which the first antenna 105 is provided), coupling between the first 105 and second 125 antennas can be changed.

In the depicted embodiment of FIGS. 2-8, the first portion of the lighting device comprises a flat body part 115 situated in an external housing 118 of the lighting device 100, and the second portion of the lighting device 100 comprises a cap part 130 mounted on the external housing 118 of the lighting device 100.

The cap part 130 is rotatably mounted on the housing such that it can be rotated moved with respect to the housing 118. Rotation of the cap part 130, upon which the second antenna 125 is supported, thus results in movement of the second antenna 125 with respect to the first antenna 105, thereby altering the electromagnetic coupling between the first 105 and second 125 antennas. This enables simple, quick and/or easy modification (e.g. tuning) of the coupling between the first 105 and second 125 antennas.

Figure 8:
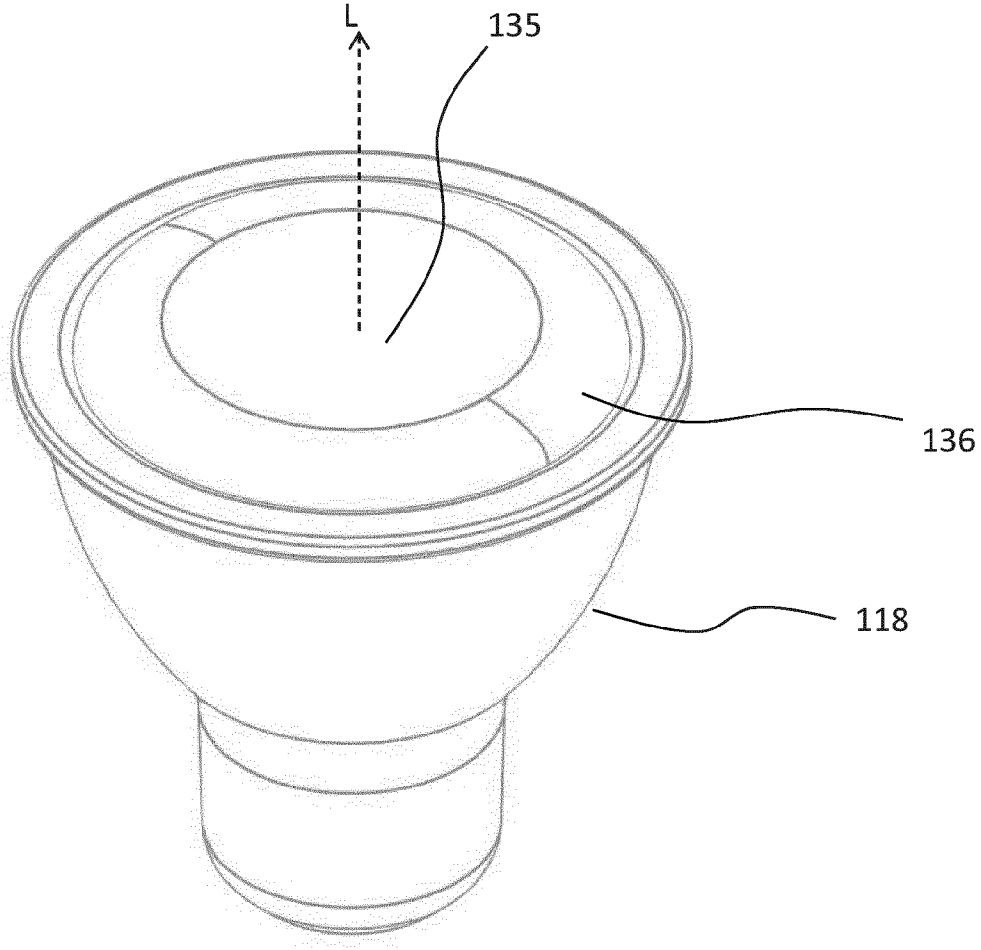
FIG. 8 is an isometric view of a lighting device in FIG. 2 wherein the cap part hides the second antenna.

In the FIG. 2, the second antenna 125 may be overmolded in the cap. The figure shows the top plane of the cap part totally transparent, but it should be understood that this is for depicting the second antenna 125 more clear. The portion of the cap part that the second antenna is placed may be opaque. Namely the second antenna 125 may also be hidden in the outer rim of the cap. As shown in FIG. 4, the cap part 130 comprises an optically transmissive part 135 through which light from a light source 140 of the lighting device 100 can pass. Put another way, the cap part 130 comprises a transparent or translucent part 135 arranged to permit the passage of light from the light source therethrough. The part 135 may be alternatively diffusive, not transparent, but is still transmissive to allow light come out. The cap part 130 further has an opaque outer rim 136 surrounding the transmissive part 135, wherein the outer rim 136 receives the second antenna 125. The second antenna 125 comprises an arc-shaped metallic component 125 which is arranged to extend around much (e.g. two/thirds) of the peripheral edge of the optically transmissive part 135 of the cap part 130. The appearance of the lamp with the opaque outer rim 136 to hide the antenna and the diffusive transmissive part 135 is shown in FIG. 8.

More preferably, the outer rim 136 further comprises recesses 137 and 137' placed at different radial locations for receiving the second antenna 125 such that the radial distance between the second antenna 125 and the first antenna 105 is adjustable. In the case as shown in FIG. 4, the second antenna 125 is received in the recess 137. The cap part 130 may therefore be understood to be similar to a screw-on cap with a curved or crescent-shaped RF antenna 125 mounted to the underside of the cap.

The housing 118 of the lighting device 100 comprises a cup-like side wall 120 comprising heat sink material. The top opening of the cup is adapted to engage with the cap part 130. A support plate 115 is placed at the middle of the cup for supporting the light source(s) 140, and comprises heat spreader material thermally coupled to the light source(s) 140 and the cup side wall 120. A PCB 145 is provided on the support plate 115 and comprises a trace 105 printed thereon as said first antenna 105.

The light source(s) 140 is/are oriented to face the cap part 130 (when it is mounted on the housing 118) and adapted to generate light along a vertical optical axis, as depicted by the arrow labelled "L" in FIG. 2. Thus, it will be appreciated that the second antenna 125 is adapted be supported by the cap part 130 so as to be positioned above a virtual plane "V" drawn orthogonal to the optical axis "L" and through the first antenna 105.

In this way, the second antenna 125 is positioned so as to be suitable for reliable communication of RF signals in a wide directivity pattern. The positioning also enables the second antenna 125 to be realised with larger dimensions than the first antenna 105, for example due to size constraints placed on the first antenna 105 situated within the housing 1180 of the lighting device 100. For example, in the depicted embodiment, the second antenna 125 comprises a metallic component having an extension no larger than ½ of a wavelength of RF control signals communicated by the first antenna 105.

More specifically, the depicted embodiment makes use of an RF-signal at the frequency of 2.4 GHz so that, in free air, the total wavelength of such a signal is 12.5 cm. Through design, the length of the second antenna is shortened in length to ½ wavelength (6.25 cm) or ¼ wavelength (3.13 cm), assuming free air with no disturbance. However, where the second antenna 125 is enclosed by the plastic material of the cap part, for example, some adjustments (or 'antenna matching' features) are needed such that the physical length of the second antenna 125 is made slightly shorter than 6.25 cm or 3.13 cm.

Increased antenna efficiency and bandwidth may therefore be obtained when compared to the first antenna 105.

Further, arrangement of the second antenna 125 above the first antenna 105 also allows the second antenna 125 to be positioned such that it is less obstructed or shielded by components and/or a housing 118 of the lighting device 100. In this way, the second antenna 125 can provide for an improved or optimized omnidirectional radiation pattern.

Finally, it is noted that the housing 118 of the lighting device 100 comprises a standard shaped power socket 150. Thus, the depicted embodiment provides a replacement lamp for replacement of halogen spots or incandescent lamps.

It will be appreciated that embodiments provide a lighting device which allows a wide spatial range of wireless RF communication with the lighting device in spite of a small overall size. Such embodiments may comprise a control circuit arranged to control a function of the lighting device in accordance with data received in an RF signal received via the first and second antennas and the RF communication circuit. For example, the function may be one or more of: on/off, intensity, color, beam width, and light orientation.

Embodiments may be employed in conjunction with new or existing lamps. For example, an embodiment may be retro-fitted to a conventional lamp, whereas another embodiment may be integrated into a new lamp at time of manufacture. Accordingly, an aspect of the invention may provide lamp comprising a lighting device according to an embodiment.

Embodiments may be employed in conjunction with a remote control unit for wireless RF control of a lighting device. Accordingly, as aspect of the invention may provide a lighting system comprising a lighting device according to an embodiment and a remote control unit adapted to communicate an RF signal for controlling of at least one parameter of the lighting device.

Although, in the depicted embodiment of FIGS. 2-8, rotation of the cap is undertaken manually, in other embodiments, it may be undertaken using an electromechanically arrangement (which can be controlled according to predetermined requirements for example). Also, in alternative embodiments, the cap part 130 may be displaceable upwardly and downwardly with respect to the first antenna 105 so as to adjust the vertical distance between the first 105 and second 125 antennas. In this way, the vertical distance, and thus the coupling, between the first 105 and second 125 antennas may be adjustable.

The second portion of the lighting device may comprise recesses placed at different radial locations for receiving said second antenna such that the radial distance between the second antenna and the first antenna is adjustable.

Other standard shaped power sockets may be employed, such as a power socket being one of: E27, E14, E40, B22, GU-10, GZ10, G4, GY6.35, G8.5, BA15d, B15, G53, and GU5.3.

Figure 9:
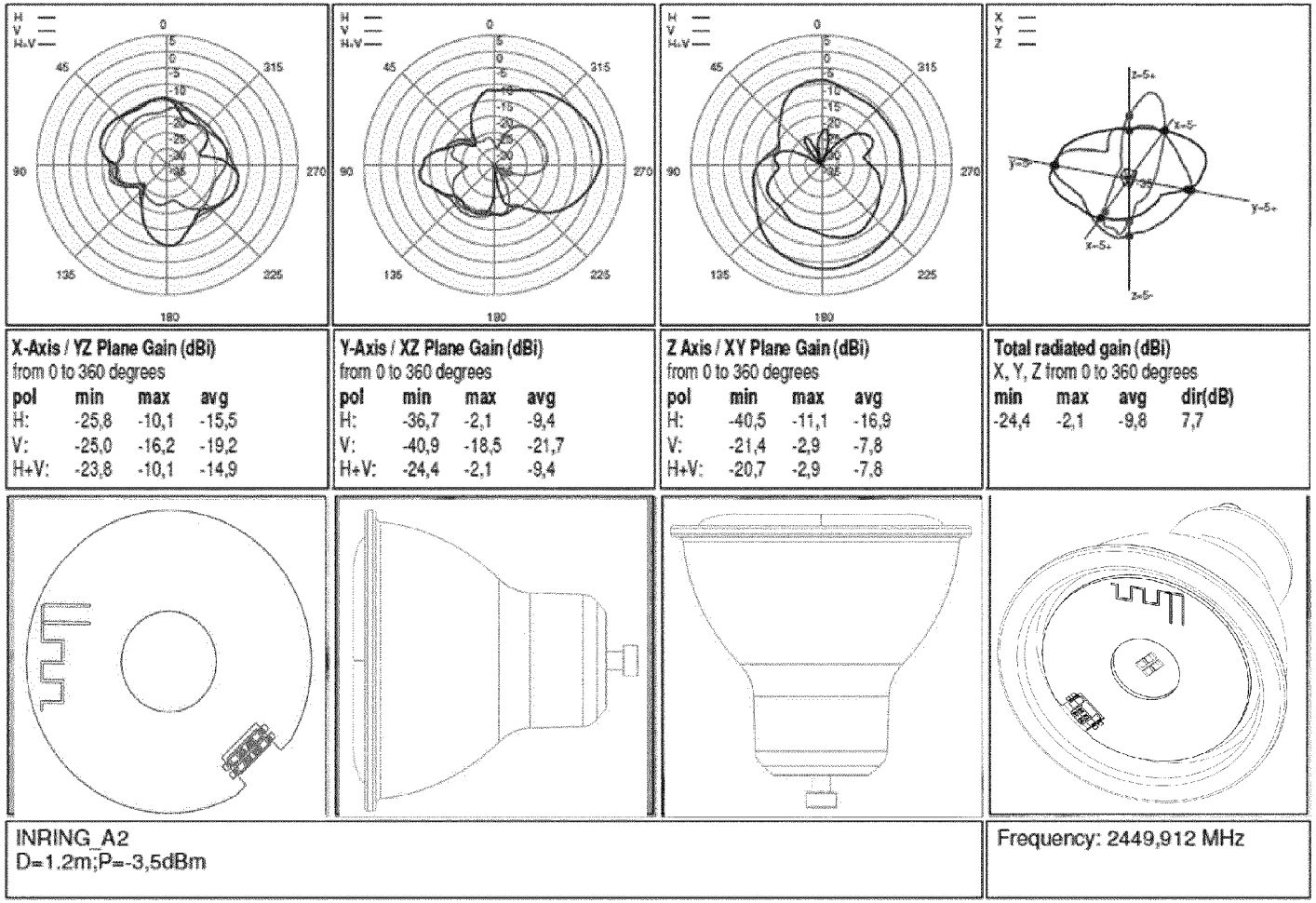
FIG. 9 shows the measured radiation patterns for different planes of the lamp according to an embodiment of the invention.

FIG. 9 shows the measured radiation patterns for different planes of the lamp according to an embodiment of the invention. Total radiated power (average EiRP) is −5.8 dBm when feeding with an RF source that delivers +4 dBm output power.

Figure 10:
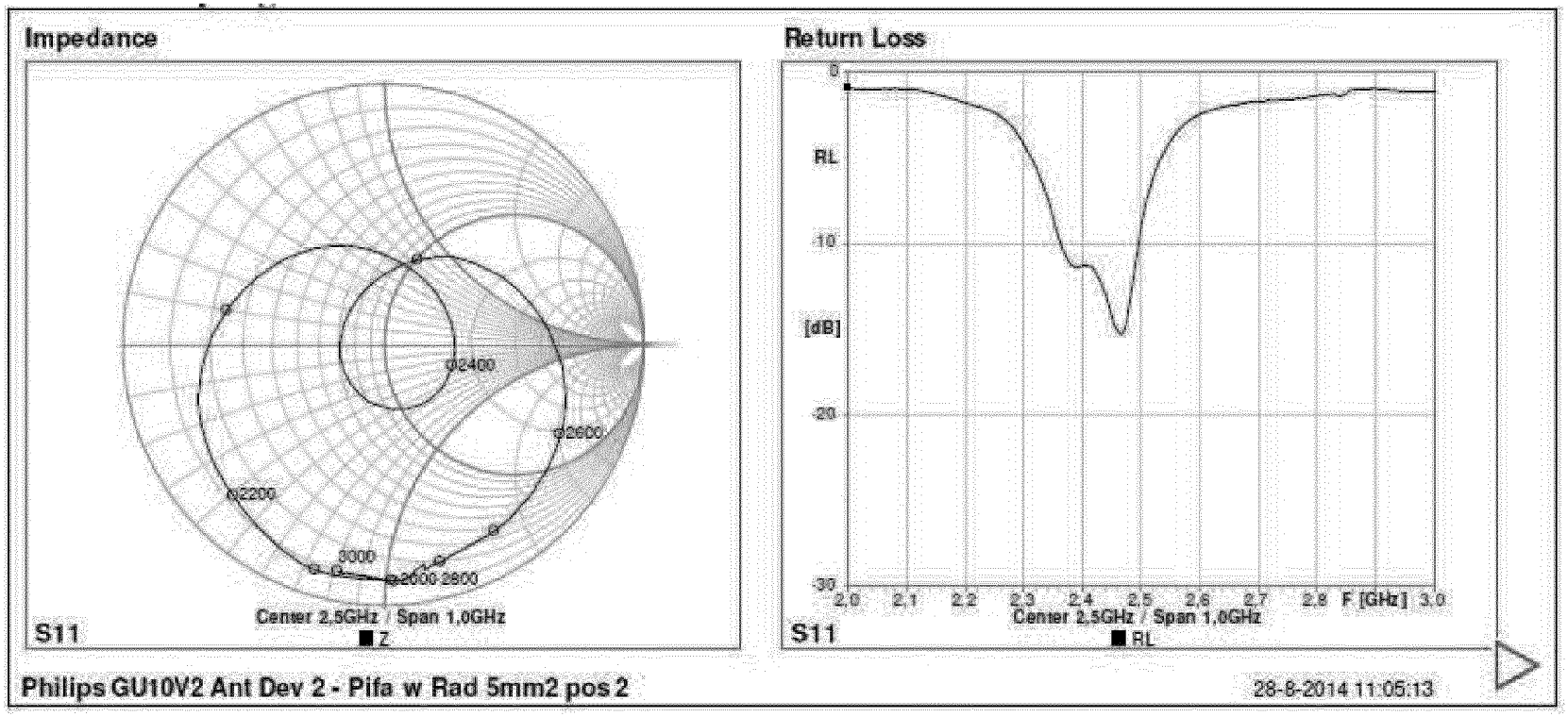
FIG. 10 shows return loss S11 according to an embodiment of the invention.

FIG. 10 shows the return loss S11. The return loss simulation is very promising and shows an S11 value better than the target −10 dB over het whole Zigbee band.

In the above embodiment, moving the second portion with respect to the first portion is mainly for improving the coupling between the second antenna and the first antenna. Alternately, moving of the second portion with respect to the first portion may be used for altering the radiation pattern of the second antenna with respect to the first portion. For example, if the second antenna is a directional antenna, such moving would change the direction of the main radiation of the second antenna with respect to the first portion. In real cases, after the lighting device has been installed, the first portion such as the main lamp body is fixed, and the operator can move the second portion to tune the direction of the second antenna to better communicate with the external wireless transceiver.

Other variations to the disclosed embodiments can be understood and effected by those skilled in the art in practicing the claimed invention, from a study of the drawings, the disclosure, and the appended claims. For example, in the above embodiment, the second antenna is discussed as a conductive/metallic component. However it can also be realized by other antenna form, such as a slot or aperture on a conductive surface wherein the first antenna excites the conductive material around the slot to emit radio signal. The term "antenna" convers any implementations that can be used for emitting radio signals essentially eligible for wireless communication purpose. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope. Although the above described preferred embodiment details a locking arrangement having a plurality of deformable portions, it will be apparent that a locking arrangement single deformable portion may be realised without departing from the scope of the invention.

The invention claimed is:

1. A lighting device with a light source and a heat dissipating element, comprising:

an RF communication circuit;

a first antenna electrically connected to the RF communication circuit and supported by a first portion of the lighting device; and a second antenna adapted to communicate with external devices and electromagnetically coupled with the first antenna so that the second antenna is adapted to be excited by and to excite the first antenna, the second antenna being supported by a second portion of the lighting device, wherein the second portion of the lighting device is movable with respect to the first portion of the lighting device.

2. The lighting device of claim 1, wherein said second portion is displaced from said heat dissipating element.

3. The lighting device of claim 1, wherein the second portion of the lighting device is movable with respect to the first portion of the lighting device so as to alter the electromagnetic coupling between the first and second antennas.

4. The lighting device of claim 1, wherein the second portion of the lighting device is movable with respect to the first portion of the lighting device so as to alter the radiation pattern of the second antenna with respect to the first portion.

5. The lighting device of claim 1, wherein the first portion of the lighting device comprises a body part situated in a housing of the lighting device, wherein said housing comprises said heat dissipating element and wherein the second portion of the lighting device comprises a cap part mounted above the housing of the lighting device.

6. The lighting device of claim 4, wherein the cap part comprises an optically transmissive part through which light from the light source can pass, and the second antenna is at the periphery of the optically transmissive part.

7. The lighting device of claim 5, wherein the body part comprises:

a cup side wall comprising a heat sink material, which constitutes at least a first part of the heat dissipating element, wherein a top opening of the cup is for engaging the cap part;

a support plate placed at the middle of the cup for supporting said light source, and comprising a heat spreader material, which constitutes at least a second part of the heat dissipating element, thermally coupled to said light source and said cup side wall; and a PCB above said support plate, comprising a trace printed thereon as said first antenna.

8. The lighting device of claim 6, wherein the light source is oriented facing said cap part and adapted to generate light along an optical axis, and wherein the second antenna is supported by the cap part so as to be positioned above a virtual plane drawn orthogonal to the optical axis and through the first antenna.

9. The lighting device of claim 1, wherein said second portion of the lighting device is rotatable with respect to said first portion of the lighting device so as to adjust the angle between said second antenna and said first antenna.

10. The lighting device of claim 1, wherein said second portion of the lighting device is displaceable upward and downward with respect to said first portion of the lighting device so as to adjust the vertical distance between said second antenna and said first antenna.

11. The lighting device of claim 1, wherein said second portion of the lighting device comprises recesses placed at different radial locations for receiving said second antenna such that the radial distance between the second antenna and the first antenna is adjustable.

12. The lighting device of claim 1, wherein the first antenna is one of: an IFA antenna; a PIFA antenna; a Yagi antenna; and a loop antenna.

13. The lighting device of claim 1, wherein the second antenna comprises a metallic component having an extension no larger than ½ of the wavelength of RF control signals communicated by the first antenna.

14. The lighting device of claim 9, wherein the second portion of the lighting device comprises dielectric materials and the extension of the metallic component of the second antenna is shorter than ½ of the wavelength of the RF control signals.

15. A lamp comprising a lighting device according to claim 1.

* * * * *